US011527812B2

(12) United States Patent
Wang et al.

(10) Patent No.: US 11,527,812 B2
(45) Date of Patent: Dec. 13, 2022

(54) TERMINAL DEVICE

(71) Applicant: VIVO MOBILE COMMUNICATION CO., LTD., Guangdong (CN)

(72) Inventors: Yijin Wang, Dongguan (CN); Huan-Chu Huang, Dongguan (CN); Xianjing Jian, Dongguan (CN)

(73) Assignee: VIVO MOBILE COMMUNICATION CO., LTD., Dongguan (CN)

( * ) Notice: Subject to any disclaimer, the term of this patent is extended or adjusted under 35 U.S.C. 154(b) by 8 days.

(21) Appl. No.: 17/156,143

(22) Filed: Jan. 22, 2021

(65) Prior Publication Data

US 2021/0143528 A1 May 13, 2021

Related U.S. Application Data

(63) Continuation of application No. PCT/CN2019/096685, filed on Jul. 19, 2019.

(30) Foreign Application Priority Data

Jul. 24, 2018 (CN) ..... 201810820138.4

(51) Int. Cl.
*H01Q 1/24* (2006.01)
*H01Q 21/06* (2006.01)
(Continued)

(52) U.S. Cl.
CPC ..... *H01Q 1/24* (2013.01); *H01Q 1/243* (2013.01); *H01Q 1/36* (2013.01); *H01Q 13/10* (2013.01);
(Continued)

(58) Field of Classification Search
CPC ..... H01Q 1/24; H01Q 15/16; H01Q 19/15; H01Q 21/064; H01Q 21/06; H01Q 1/243; H01Q 13/10; H01Q 1/36
(Continued)

(56) References Cited

U.S. PATENT DOCUMENTS 8,836,587 B2 * 9/2014 Darnell ..... H01Q 1/50 343/702
2009/0315794 A1 12/2009 Alamouti et al.
(Continued)

FOREIGN PATENT DOCUMENTS

CN 101427420 A 5/2009
CN 201590480 U 9/2010
(Continued)

OTHER PUBLICATIONS

First Office Action regarding Chinese Patent Application No. 20180820138.4, dated Apr. 24, 2020. Translation provided by Bohui Intellectual Property.
(Continued)

*Primary Examiner* — Hai V Tran
(74) *Attorney, Agent, or Firm* — Harness, Dickey & Pierce, P.L.C.

(57) ABSTRACT

A terminal device includes a metal frame having at least two slots disposed on a side of the metal frame. At least two antenna feedpoints are disposed on an inner side wall of the metal frame, and different antenna feedpoints in the at least two antenna feedpoints are disposed on side edges of different slots. A signal reflection wall is further provided inside the terminal device, and a gap exists between the signal reflection wall and the at least two slots. The signal reflection wall is formed by a metal wall of a battery chamber of the terminal device, and the battery chamber is a structure that accommodates a battery of the terminal device. The metal frame and the signal reflection wall are both electrically connected to a ground plate of the terminal device.

17 Claims, 10 Drawing Sheets

(51) Int. Cl.
*H01Q 15/16* (2006.01)
*H01Q 19/15* (2006.01)
*H01Q 1/36* (2006.01)
*H01Q 13/10* (2006.01)

(52) U.S. Cl.
CPC ..... *H01Q 15/16* (2013.01); *H01Q 19/15* (2013.01); *H01Q 21/06* (2013.01); *H01Q 21/064* (2013.01)

(58) Field of Classification Search
USPC ..... 343/770
See application file for complete search history.

(56) References Cited

U.S. PATENT DOCUMENTS

| | | | | |
|---|---|---|---|---|
| 2011/0006953 | A1* | 1/2011 | Chiang | H01Q 1/2266 343/702 |
| 2011/0234467 | A1* | 9/2011 | Huang | H01Q 3/00 343/837 |
| 2014/0078008 | A1* | 3/2014 | Kang | H01Q 21/30 343/702 |
| 2014/0320355 | A1 | 10/2014 | Saito et al. | |
| 2017/0302771 | A1* | 10/2017 | Kim | H04M 1/0266 |
| 2017/0346164 | A1* | 11/2017 | Kim | H01Q 1/243 |

FOREIGN PATENT DOCUMENTS

| | | | |
|---|---|---|---|
| CN | 102544693 | A | 7/2012 |
| CN | 103947043 | A | 7/2014 |
| CN | 104282982 | A | 1/2015 |
| CN | 104659463 | A | 5/2015 |
| CN | 104901004 | A | 9/2015 |
| CN | 105789904 | A | 7/2016 |
| CN | 105933481 | A | 9/2016 |
| CN | 106454608 | A | 2/2017 |
| CN | 106785384 | A | 5/2017 |
| CN | 106935962 | A | 7/2017 |
| CN | 206370500 | U | 8/2017 |
| CN | 206412466 | U | 8/2017 |
| CN | 107317097 | A | 11/2017 |
| CN | 108110417 | A | 6/2018 |
| CN | 108270080 | A | 7/2018 |
| CN | 207624903 | U | 7/2018 |
| CN | 108987905 | A | 12/2018 |
| CN | 108987906 | A | 12/2018 |
| CN | 108987944 | A | 12/2018 |
| CN | 108987945 | A | 12/2018 |
| EP | 1033779 | A2 | 9/2000 |
| EP | 1418642 | A2 | 5/2004 |

OTHER PUBLICATIONS

Second Office Action regarding Chinese Patent Application No. 20180820138.4, dated Oct. 20, 2020. Translation provided by Bohui Intellectual Property.

International Search Report and Written Opinion of the International Searching Authority regarding International Application No. PCT/CN/2019/096685, dated Oct. 22, 2019. Translation provided by Bohui Intellectual Property.

* cited by examiner

TERMINAL DEVICE

CROSS-REFERENCE TO RELATED APPLICATIONS

This application is a Bypass Continuation Application of PCT/CN2019/096685 filed on Jul. 19, 2019, which claims priority to Chinese Patent Application No. 201810820138.4 filed on Jul. 24, 2018, which are incorporated herein by reference in their entirety.

TECHNICAL FIELD

The present disclosure relates to the field of communications technologies, and in particular, to a terminal device.

BACKGROUND

With the rapid development of communications technologies, multi-antenna communication has become the mainstream and future development trend of terminal devices, and millimeter-wave antenna arrays are gradually introduced to terminal devices during this process.

SUMMARY

Some embodiments of the present disclosure provide a terminal device. The terminal device includes a metal frame. At least two slots are disposed on a side of the metal frame. At least two antenna feedpoints are disposed on an inner side wall of the metal frame, and different antenna feedpoints in the at least two antenna feedpoints are disposed on side edges of different slots.

A signal reflection wall is further disposed inside the terminal device. A gap exists between the signal reflection wall and the at least two slots, and the signal reflection wall is formed by a metal wall of a battery chamber of the terminal device, wherein the battery chamber is a structure accommodating a battery of the terminal device.

The metal frame and the signal reflection wall are both electrically connected to a ground plate of the terminal device.

BRIEF DESCRIPTION OF THE DRAWINGS

In order to describe technical solutions in embodiments of the present disclosure more clearly, the accompanying drawings to be used in the description of embodiments of the present disclosure will be introduced briefly below. Obviously, the accompanying drawings in the following description are merely some embodiments of the present disclosure, and a person of ordinary skill in the art may also obtain other drawings according to those drawings.

DETAILED DESCRIPTION

Technical solutions in some embodiments of the present disclosure will be described clearly with reference to accompanying drawings in some embodiments of the present disclosure. Obviously, the described embodiments are merely some but not all the embodiments of the present disclosure. Other embodiments obtained on a basis of the embodiments of the present disclosure by a person of ordinary skill in the art shall be included in the protection scope of the present disclosure.

In the related art, a millimeter-wave antenna array is generally in a form of an independent antenna module, and thus an accommodating space needs to be provided for the independent antenna module in a terminal device, which may cause that the whole terminal device is large in volume and size, thereby resulting in a relatively low overall competitiveness of the terminal device. In addition, for the design of the current mainstream millimeter-wave antenna array, it is usually difficult to show better antenna performance under a design of metal appearance, that is, it is difficult to support the design of metal appearance, and thus the competitiveness of the terminal device is reduced.

Some embodiments of the present disclosure provide a terminal device. For ease of understanding, the terminal device will be described below with reference to FIGS. 1 to 13.

Figure 1:
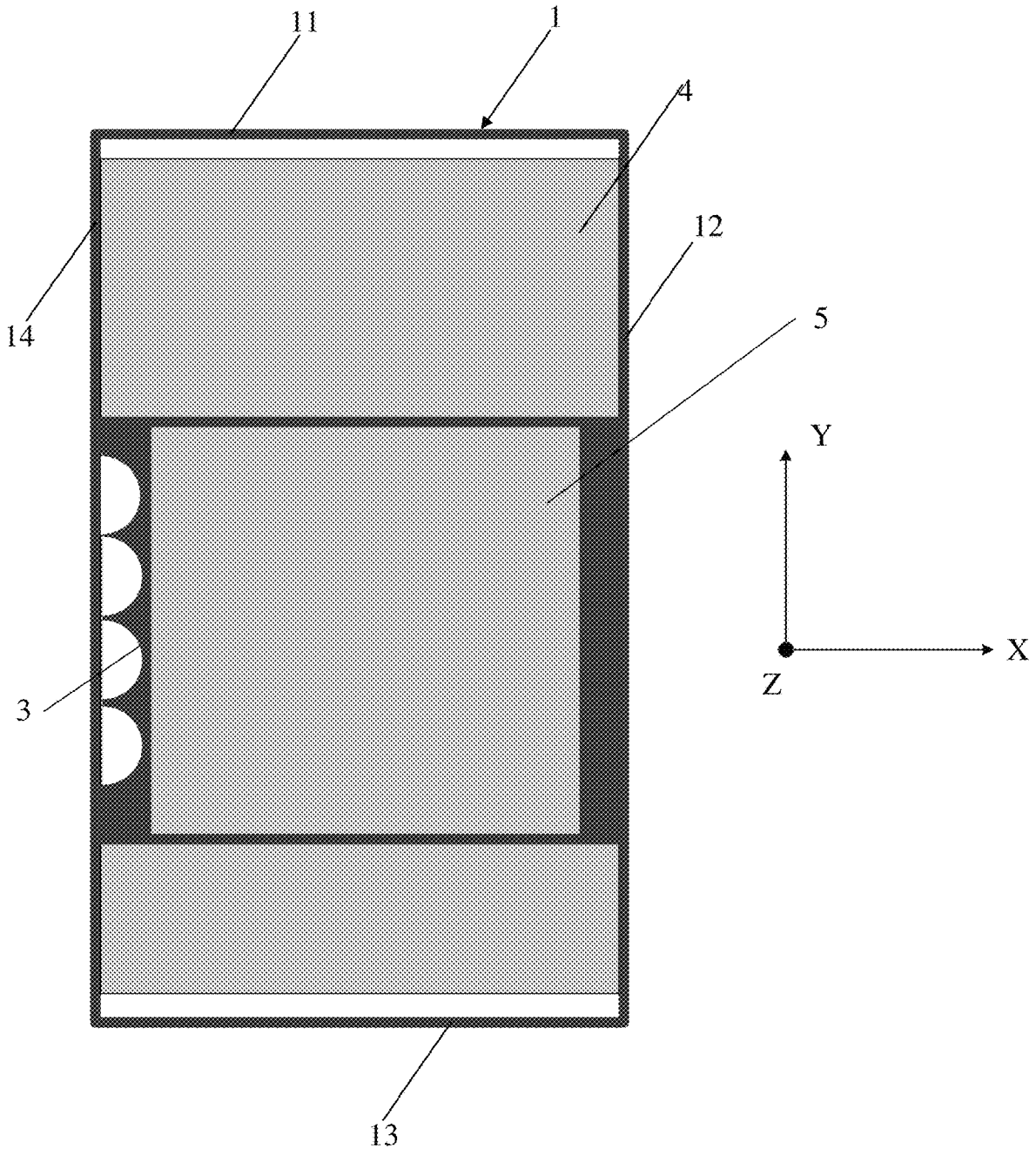
FIG. 1 is a schematic diagram showing a structure of a terminal device, in accordance with some embodiments of the present disclosure.

Referring to FIG. 1, the terminal device provided by some embodiments of the present disclosure includes a metal frame 1, and at least two slots 15 are disposed on a side of the metal frame 1. At least two antenna feedpoints 2 are disposed on an inner side wall of the metal frame 1, and different antenna feedpoints in the at least two antenna feedpoints 2 are located on side edges of different slots 15. The terminal device further has a signal reflection wall 3 disposed inside the terminal device, and there is a gap between the signal reflection wall 3 and the at least two slots 15. The signal reflection wall 3 is formed by a metal wall of a battery chamber 5 of the terminal device. The metal frame 1 and the signal reflection wall 3 are both electrically connected to a ground plate 4 of the terminal device. The battery chamber is a structure that accommodates a battery of the terminal device.

In this embodiment, the metal frame 1 may be a frame with a head portion and a tail portion connected or unconnected, and the metal frame 1 may include a first side 11, a second side 12, a third side 13 and a fourth side 14. The at least two slots 15 may be disposed on one side of the metal frame 1. Alternatively, two opposite sides of the metal frame 1 may be both provided with at least two slots 15. The slots 15 may be filled with air or a non-conductive material, or the like.

In this embodiment, at least two antenna feedpoints 2 are disposed on the inner side wall of the metal frame 1, and different antenna feedpoints 2 in the at least two antenna feedpoints 2 are located on side edges of different slots 15, so that it may be ensured that there are at least two slots 15 on a side of the metal frame 1 and each of which has an antenna feedpoint 2, and thus the at least two slots 15 may form a millimeter-wave antenna array. The antenna feedpoints 2 of the millimeter-wave antenna array are located on side edges of the slots 15. For example, the antenna feedpoints 2 may be located on a side of centers of the slots 15, so that millimeter-wave signals may be led to the antenna feedpoints 2 of the millimeter-wave antenna array, and are radiated through the metal frame 1. Besides, the metal frame 1 can also receive millimeter-wave signals. Of course, it is optional that each slot 15 may be provided with an antenna feedpoint 2.

In this embodiment, due to the existence of the signal reflection wall 3, the performance of the antenna may be enhanced, and the gain of the antenna may be improved. There is a gap between the signal reflection wall 3 and the at least two slots 15, and the gap may be filled with air, or some non-conductive materials, or the like.

Figure 2:
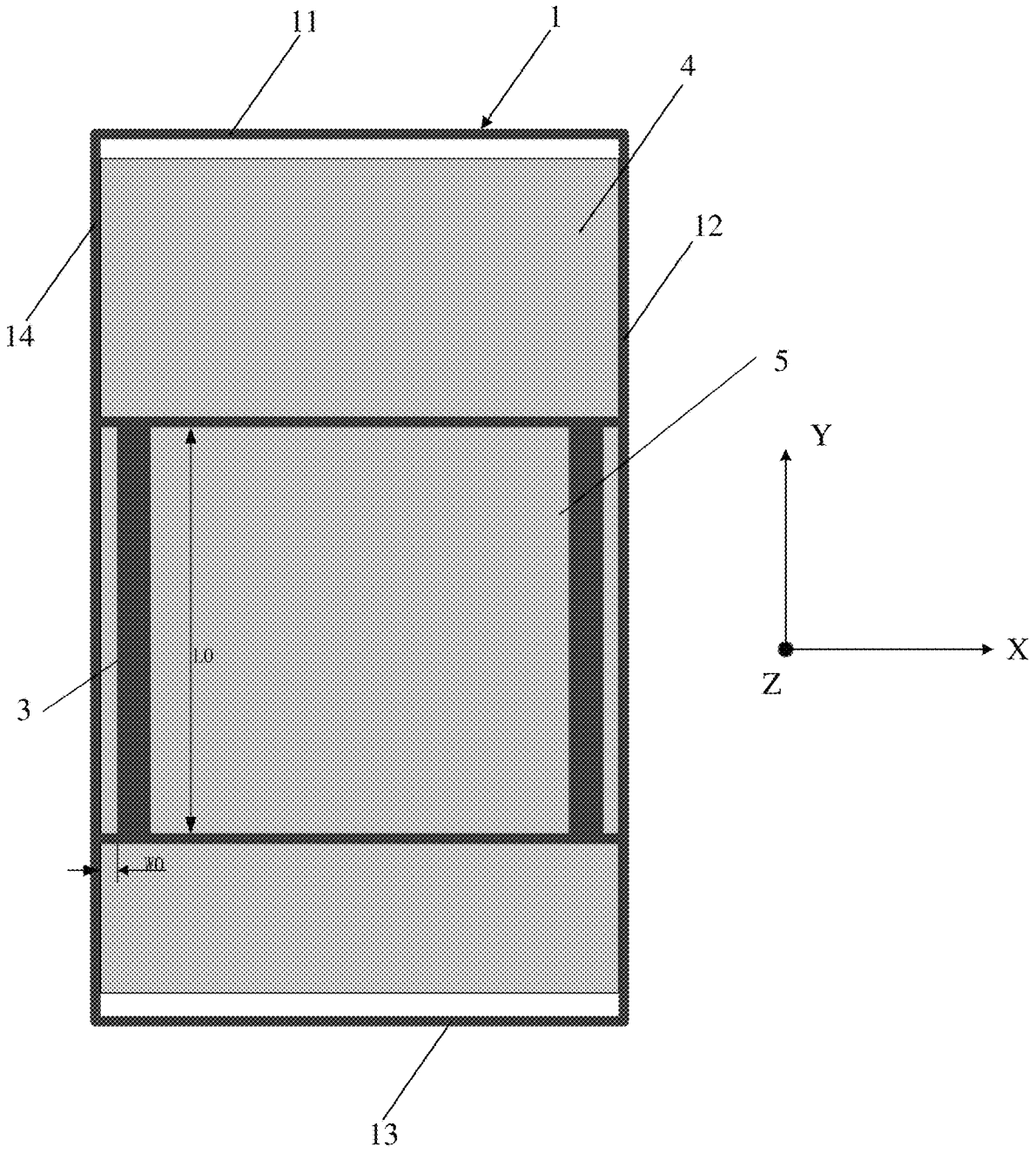
FIG. 2 is a schematic diagram showing a structure of a terminal device, in accordance with some embodiments of the present disclosure.

In this implementation, a side frame of the metal wall of the battery chamber in a length direction of the terminal device may be wider. The signal reflection wall 3 may be a reflection curved surface that is convex or concave, as shown in FIG. 1. The signal reflection wall 3 may also be a flat surface, as shown in FIG. 2. Generally, the terminal device has a battery chamber, and thus the metal wall of the battery chamber is directly used as a signal reflection wall, which makes it unnecessary to add additional materials, thereby saving the cost of the terminal device.

In this embodiment, the battery chamber 5 may be disposed above the ground plate 4, and the metal wall of the battery chamber 5 serves as the signal reflection wall 3 of the antenna (e.g., the millimeter-wave antenna array). The ground plate 4 may be a circuit board, a metal housing or a screen, etc. The metal frame 1 and the signal reflection wall 3 are both electrically connected to the ground plate 4 of the terminal device, so that the metal frame 1 and the signal reflection wall 3 may be grounded.

Figure 3:
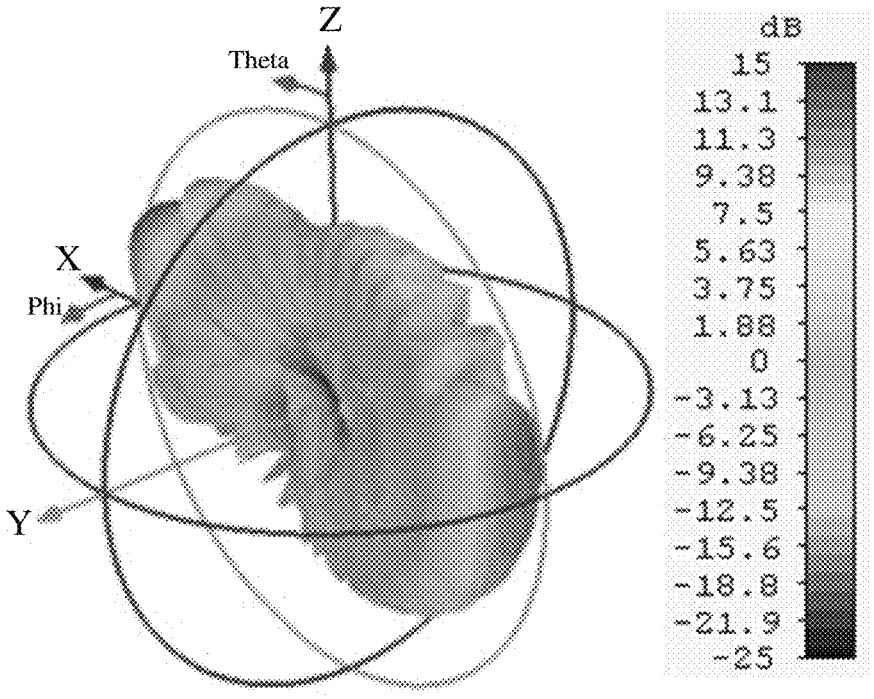
FIG. 3 is a schematic diagram showing a radiation pattern, in accordance with some embodiments of the present disclosure.
Figure 4:
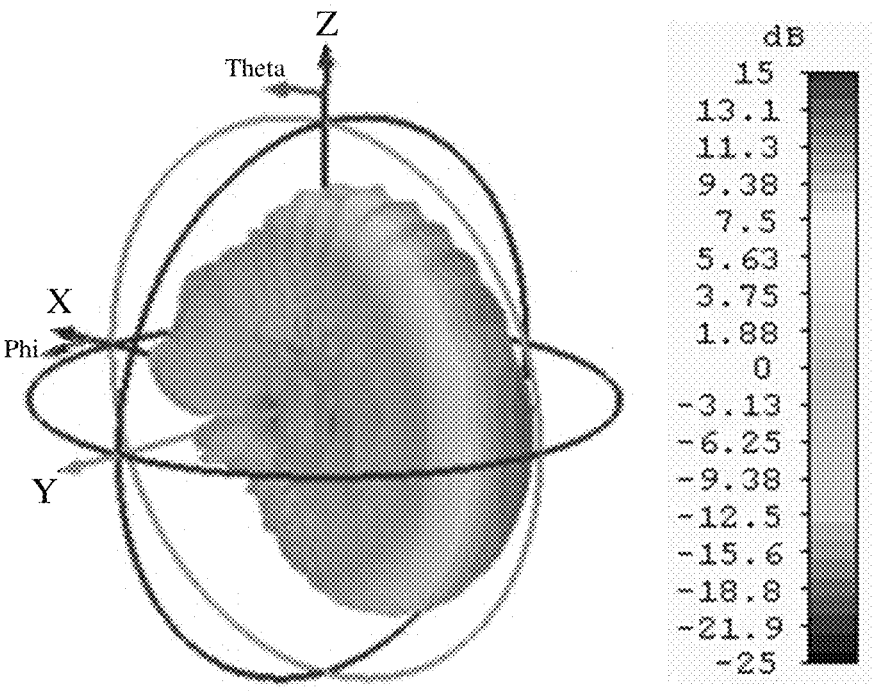
FIG. 4 is another schematic diagram showing a radiation pattern, in accordance with some embodiments of the present disclosure.

In this embodiment, the performance of the millimeter-wave antenna array may be enhanced by directly using the metal wall of the battery chamber as the signal reflection wall 3. Referring to FIGS. 3 and 4, the radiation pattern shown by FIG. 3 is a radiation pattern of an antenna array when there is no battery chamber or the battery chamber has no special design. The radiation pattern shown by FIG. 4 is the radiation pattern of an antenna array when the battery chamber has a special design (e.g., a parabolic design) and is disposed near a millimeter-wave slot antenna array. Scales in FIGS. 3 and 4 show an increase in gain from the zero scales upwards and a decrease from the zero scales downwards.

In FIG. 3, a gain in a positive direction and a negative direction of the X axis are larger, and a gain near the origin of coordinates is smaller. For FIG. 3, a gain of a back lobe (the positive direction of the X axis) is larger than a gain of a positive direction of the X axis in FIG. 4, and thus a beamwidth of a main lobe (the negative direction of the X axis) in FIG. 3 is narrower than a beamwidth of a main lobe (a negative direction of the X axis) in FIG. 4, and a gain of the main lobe in FIG. 3 is smaller than the gain of the main lobe in FIG. 4.

In FIG. 4, a gain in a negative direction of the X axis is larger, and a gain near the origin of coordinates is smaller. For FIG. 4, a gain of a back lobe (the positive direction of the X axis) is smaller than the gain of the positive direction of the X axis in FIG. 3, and thus the beamwidth of the main lobe (the negative direction of the X axis) in FIG. 4 is wider than the beamwidth of the main lobe (the negative direction of the X axis) in FIG. 3, and the gain of the main lobe in FIG. 4 is larger than the gain of the main lobe in FIG. 3.

In this way, in some embodiments of the present disclosure, at least two slots 15 are provided on a side of the metal frame of the terminal device, which is equivalent to forming a millimeter-wave antenna array, and which may save the space accommodating the millimeter-wave antenna array without occupying antenna space of other antennas, and may further reduce a volume of the terminal device, and thus overall competitiveness of the terminal device may be improved. In addition, taking advantage of the structure of the terminal device as the antenna improves the communication effect, and does not affect the metal texture of the terminal device. Moreover, using the metal wall of the battery chamber directly as the signal reflection wall 3 may enhance the performance of the millimeter-wave antenna array, improve the gain of the millimeter-wave antenna array, and optimize the radiation pattern of the antenna array. What is more, it is also unnecessary to add additional materials, which may save the cost of the terminal.

In addition, for the design of the current mainstream millimeter-wave antenna array, it is usually difficult to show better antenna performance under a design of metal appearance, that is, it is difficult to support the design of metal appearance, and thus the competitiveness of the terminal device is reduced. The design of the embodiment may better support the design of metal appearance, and may be compatible with a scheme that the appearance metal serves as other antennas, so as to improve the overall competitiveness of the product. The terminal device provided by some embodiments of the present disclosure not only solves a problem of the whole terminal device being large in volume and size, which is caused by that an accommodating space needs to be provided for a millimeter-wave antenna in the terminal device, but also solves a problem that it is difficult for the terminal device to support the design of metal appearance.

In some embodiments of the present disclosure, the terminal device may be a mobile phone, a tablet personal computer, a laptop computer, a personal digital assistant (PDA), a mobile Internet device (MID), a wearable device, or the like.

Optionally, the signal reflection wall 3 is a concave reflection curved surface.

In this embodiment, a directivity of an antenna signal may be improved by reflecting the antenna signal through the reflection curved surface.

Optionally, the reflection curved surface is formed by a generatrix parallel to a length direction of the metal frame; or the reflection curved surface is formed by a generatrix parallel to a width direction of the metal frame.

In this implementation, the reflection curved surface is formed by the generatrix parallel to the length direction of the metal frame. For example, referring to FIG. 5, the reflection curved surface is a paraboloid formed along the Y axis on the XZ plane of the coordinate system of the terminal device. Alternatively, the reflection curved surface is formed by the generatrix parallel to the width direction of the metal frame. For example, referring to FIG. 1, the reflection curved surface is a paraboloid formed along the Z axis on the XY plane of the coordinate system of the terminal device. In this way, a plurality of arrangements of the reflection curved surface are provided for the terminal device, and the terminal device can select an appropriate arrangement according to actual needs.

Optionally, the reflection curved surface is a paraboloid.

Figure 5:
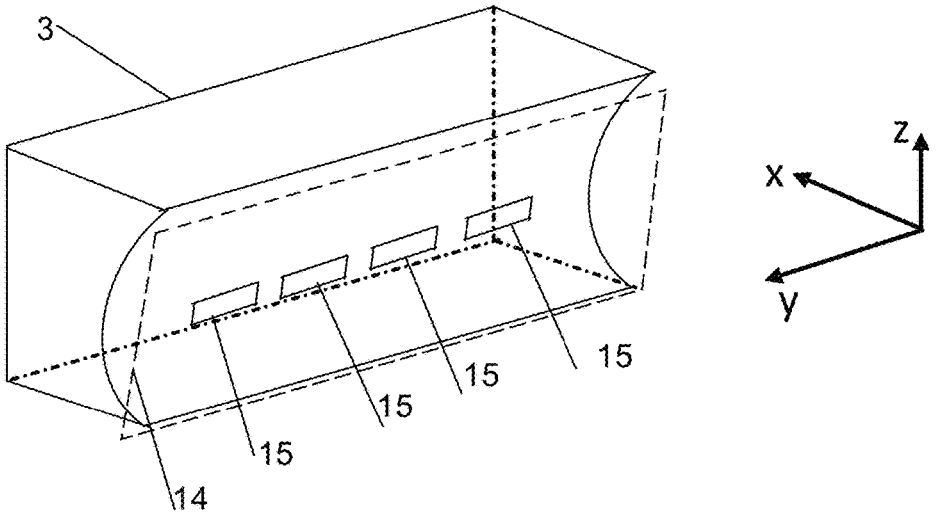
FIG. 5 is a schematic diagram showing a structure of a reflection curved surface, in accordance with some embodiments of the present disclosure.

In order to better understand that the reflection curved surface is a paraboloid, reference can be made to FIG. 5. The fourth side 14 is shown by the dotted line in the figure, and at least four slots 15 are provided on the fourth side 14. A concave paraboloid is located at a position near the fourth side 14. The paraboloid is the signal reflection wall 3 formed by the metal wall of the battery chamber of the terminal device, and can be used to reflect millimeter-wave signals radiated by the fourth side 14. By designing the reflection curved surface as a paraboloid, the gain of the antenna may be optimized.

And the above arrangement can be understood in this way: digging the wider metal wall of the battery chamber along the Y-axis direction, such that the battery chamber forms an integrally concave reflection curved surface (which may be a paraboloid) that has opening portions facing a slot array formed by the plurality of slots 15. The integrally concave reflection curved surface is formed along the Y axis on the XZ plane, and the plurality of slots 15 are still on the fourth side 14 of the metal frame 1. That is, the slot array formed by the plurality of slots 15 is not at a same X position as the concave reflection curved surface.

Optionally, an upper edge of the signal reflection wall is not lower than upper edges of the slots, and a lower edge of the signal reflection wall is not higher than lower edges of the slots.

In this implementation, the upper edge of the signal reflection wall 3 is not lower than the upper edges of the slots 15, and the lower edge of the signal reflection wall 3 is not higher than the lower edges of the slots 15, so that the signal reflection wall 3 formed by the metal wall of the battery chamber may well cover the slots 15 to facilitate better reflection of signals.

Figure 6:
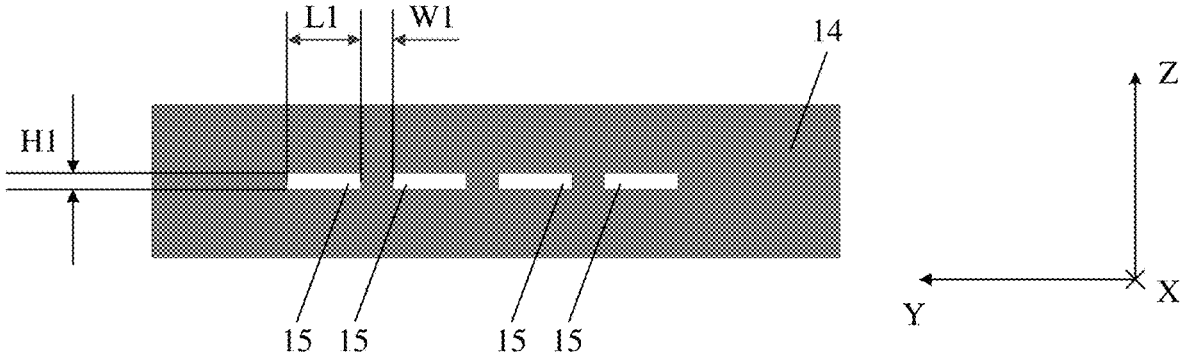
FIG. 6 is a schematic diagram showing a structure of a side of a metal frame, in accordance with some embodiments of the present disclosure.
Figure 7:
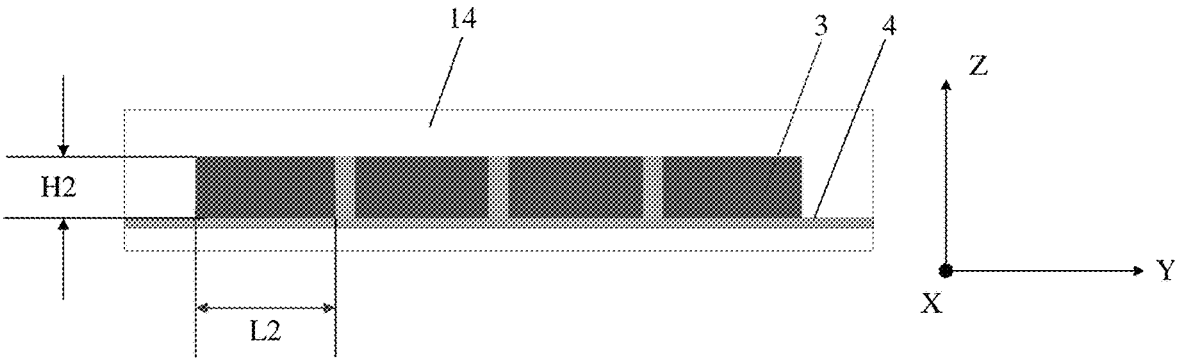
FIG. 7 is a schematic diagram showing a relative position of a signal reflection wall and a side of a metal frame, in accordance with some embodiments of the present disclosure.

In order to better understand the above arrangement, reference may be made to FIGS. 6 and 7. As can be seen from FIG. 6, there are at least four slots 15 on the fourth side 14 of the metal frame 1, and a length of a slot 15 is L1. L1 may be approximately half of a wavelength corresponding to a center frequency of an operating frequency band of the millimeter-wave antenna. A width H1 of the slot 15 is not limited. A distance between edges of two adjacent slots 15 is W1, and the distance W1 may be determined by an isolation between two adjacent antennas and a beam scanning coverage angle of the millimeter-wave antenna array. In FIG. 7, a thickness of the battery chamber is H2, the battery chamber and the slots 15 are on a same side of the ground plate 4, and H2 is greater than or equal to H1. In this way, the upper edge of the signal reflection wall 3 formed by the metal wall of the battery chamber may be set no lower than the upper edges of the slots 15, and the lower edge of the signal reflection wall 3 may be set no higher than the lower edges of the slots 15. Therefore, the slots 15 may be covered well to facilitate better reflection of signals.

Optionally, the signal reflection wall 3 includes at least two reflection curved surfaces that are in a one-to-one correspondence with arrangement positions of the slots.

In this implementation, one reflection curved surface may be provided for each slot 15 to facilitate better reflection of signals. In order to better understand the above arrangement, reference may also be made to FIGS. 6 and 7. In FIG. 7, a length of a slot 15 is L1, and there are at least four slots 15 on the fourth side 14 of the metal frame 1. In FIG. 7, a length of a reflection curved surface is L2, and there are at least four reflection curved surfaces. In this way, each reflection curved surface may correspond to one slot 15 to facilitate better reflection of signals. Of course, the number of reflection curved surfaces may be greater than or equal to the number of slots 15, so as to ensure that each slot 15 can correspond to one reflection curved surface. It will be noted that an interface of adjacent reflection curved surfaces may be connected to the fourth side 14, or may not be connected to the fourth side 14.

In order to make a reflection curved surface corresponding to each slot 15 better cover the slot 15, L2 may be set to be greater than or equal to L1. In addition, a convex portion of each reflection curved surface may point to a corresponding slot 15, and there is a certain distance between the convex portion and the slot 15.

Optionally, the reflection curved surface is a paraboloid, and a focus of the paraboloid coincides with a midpoint of a slot corresponding to an arrangement position of the paraboloid.

In this embodiment, by coinciding the focus of the paraboloid with the midpoint of the slot corresponding to the arrangement position of the paraboloid, antenna gain and beam directivity may be improved.

Optionally, the at least two slots 15 are arranged along a length direction of the metal frame 1, a length of each slot 15 is the same, and a distance between any two adjacent slots 15 is the same.

In this implementation, the at least two slots 15 are arranged along the length direction of the metal frame 1, the length of each slot 15 is the same, and the distance between any two adjacent slots 15 is the same, so that the at least two slots 15 can form a slot group to facilitate better radiation of millimeter-wave signals.

Optionally, the distance between two adjacent slots 15 is determined by the isolation between two adjacent antennas and the beam scanning coverage angle of the antenna array.

In this implementation, the distance between two adjacent slots 15 is determined by the isolation between two adjacent antennas and the beam scanning coverage angle of the antenna array, so that the millimeter-wave signals may be better matched for operation.

Optionally, the slot 15 includes a first sub-slot 151 and a second sub-slot 152 that are intersected with each other.

Figure 8:
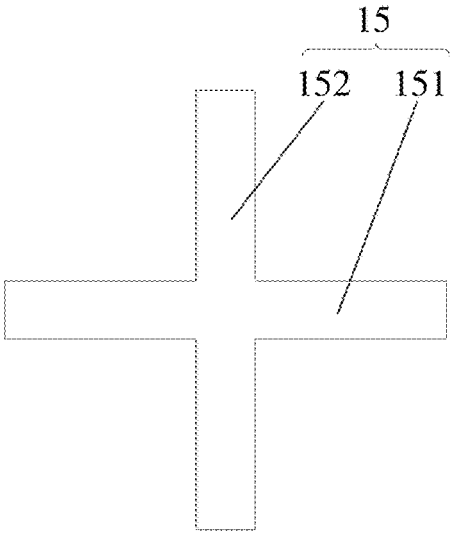
FIG. 8 is a schematic diagram showing a structure of a slot, in accordance with some embodiments of the present disclosure.

In order to better understand the above arrangement, reference may be made to FIG. 8, and the slot 15 includes the first sub-slot 151 and the second sub-slot 152 that are intersected with each other. In this way, 15 may have horizontal polarization performance and vertical polarization performance.

Optionally, the signal reflection wall includes a first reflection curved surface 31 that is concave and corresponding to the first sub-slot 151, and a second reflection curved surface 32 that is concave and corresponding to the second sub-slot 152. A generatrix forming the first reflection curved surface 31 is intersected with a generatrix forming the second reflection curved surface 32.

Figure 9:
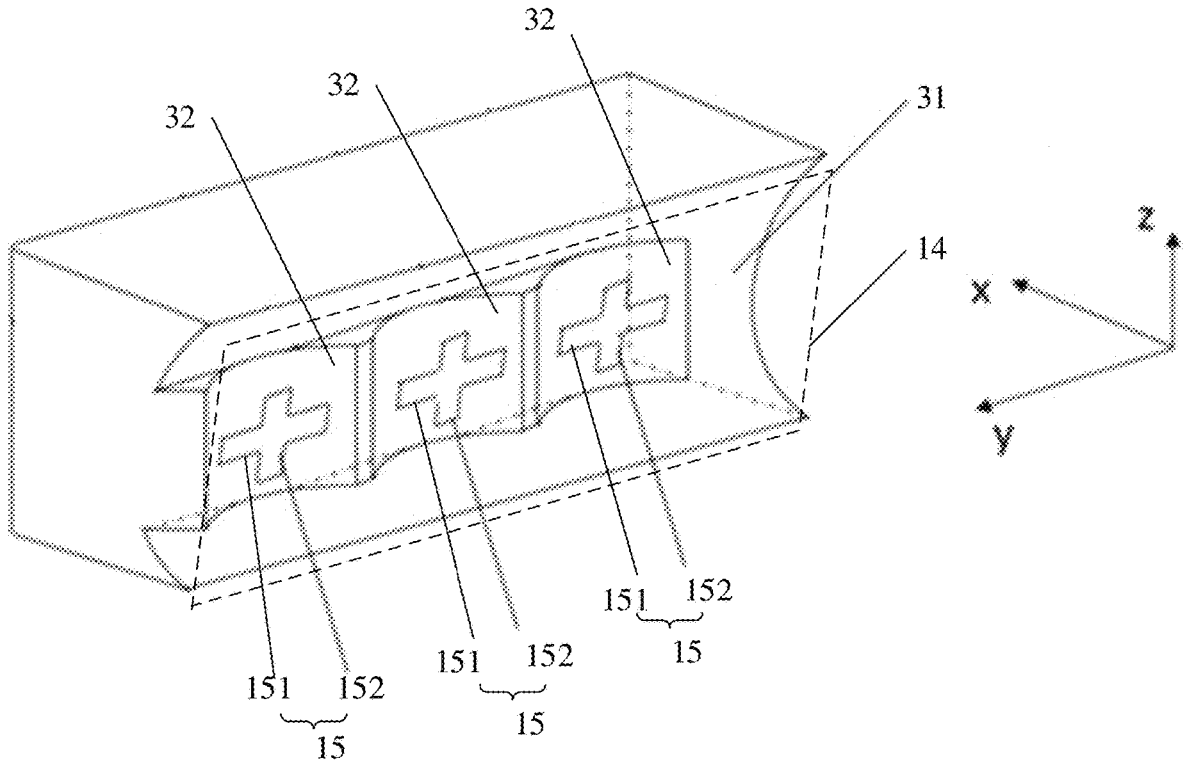
FIG. 9 is another schematic diagram showing a structure of a reflection curved surface, in accordance with some embodiments of the present disclosure.

In this implementation, in order to better understand the above arrangement, reference can be made to FIG. 9, and FIG. 9 is a schematic diagram provided by some embodiments of the present disclosure showing a structure of a reflection curved surface. In FIG. 9, the fourth side 14 is shown by the dotted line in the figure, and three slots 15 are provided on the fourth side. Each slot includes a first sub-slot 151 and a second sub-slot 152. A reflection curved surface corresponding to the first sub-slot 151 is the first reflection curved surface 31, and the first reflection curved surface 31 is a larger concave curved surface. A reflection curved surface corresponding to the second sub-slot 152 is a second reflection curved surface 32, and three second reflection curved surfaces 32 are provided on the first reflection curved surface 31. The second reflection curved surfaces 32 are smaller concave curved surfaces, and each second reflection curved surface 32 corresponds to one slot 15. The generatrix forming the first reflection curved surface 31 is intersected with the generatrix forming the second reflection curved surface 32.

Or the above arrangement may be understood in this way: as shown in FIG. 9, digging the wider metal wall of the battery chamber along the Y-axis direction, such that the metal wall of the battery chamber forms a concave first reflection curved surface 31 and a plurality of concave second reflection curved surfaces 32. The first reflection curved surface 31 is a paraboloid formed along the Y axis on the XZ plane of the coordinate system of the terminal device, the second reflection curved surface 32 is a paraboloid formed along the Z axis on the XY plane of the coordinate system of the terminal device, and the first reflection curved surface 31 is orthogonal to the plurality of second reflection curved surfaces 32. A plurality of slots 15 are provided on the fourth side 14 of the metal frame 1, and each slot 15 has horizontal polarization performance and vertical polarization performance. Opening directions of the first reflection curved surface 31 and the plurality of second reflection curved surfaces 32 both point to the slot group formed by the plurality of slots 15, the plurality of second reflection curved surfaces 32 are in a one-to-one correspondence with the plurality of slots 15, and the slot array formed by the plurality of slots 15 is not at a same X position as the plurality of second reflection curved surfaces 32 (both the first reflection curved surface 31 and the second reflection curved surfaces 32 may be paraboloids).

In this implementation, the millimeter-wave antenna array formed by the slot group has both horizontal polarization performance and vertical polarization performance, which improves wireless connection capability. Moreover, a parabolic design may further improve coverage of a scanning angle of the main lobe.

Optionally, a long side of the first sub-slot 151 is orthogonal to a long side of the second sub-slot 152, and/or the generatrix forming the first reflection curved surface 31 is orthogonal to the generatrix forming the second reflection curved surface 32.

In this implementation, the long side of the first sub-slot 151 is orthogonal to the long side of the second sub-slot 152, which may be understood as that the first sub-slot 151 is perpendicular to the second sub-slot 152. The generatrix forming the first reflection curved surface 31 is orthogonal to the generatrix forming the second reflection curved surface 32, which may be understood as that the generatrix forming the first reflection curved surface 31 is perpendicular to the generatrix forming the second reflection curved surface 32. Therefore, the horizontal polarization performance and the vertical polarization performance of the slot 15 may be further improved.

Optionally, two opposite sides of the metal frame 1 are both provided with at least two slots 15.

Two opposite sides of the metal frame 1 are both provided with at least two slots 15, and the at least two slots 15 on a same side can form a slot group, so that there is a slot group on both the two opposite sides of the metal frame 1, which may further improve a beam coverage of the millimeter-wave antenna array. In order to better understand the above arrangement, the following description will be made with reference to FIGS. 10 to 12.

Figure 10:
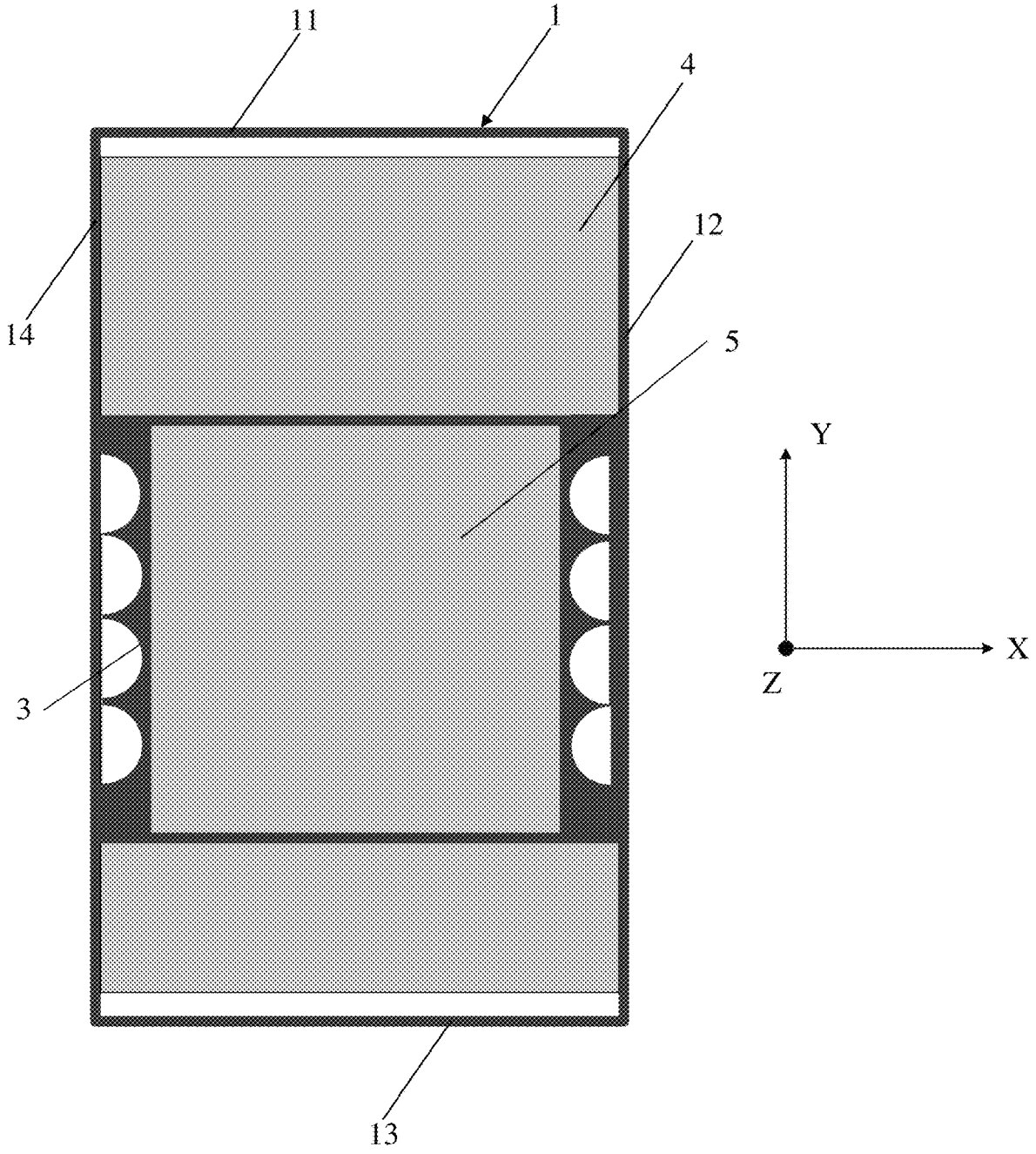
FIG. 10 is yet another schematic diagram showing a structure of a terminal device, in accordance with some embodiments of the present disclosure.
Figure 11:
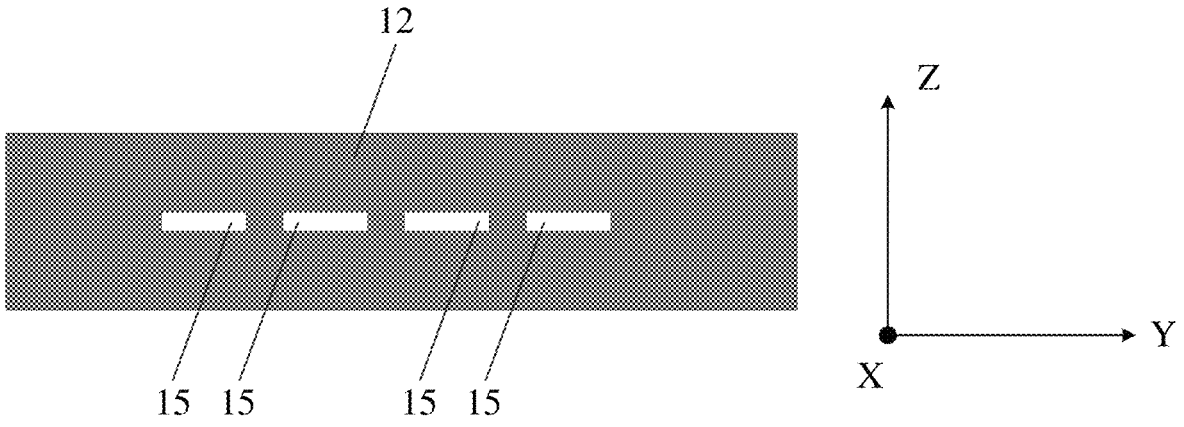
FIG. 11 is another schematic diagram showing a structure of a side of a metal frame, in accordance with some embodiments of the present disclosure.
Figure 12:
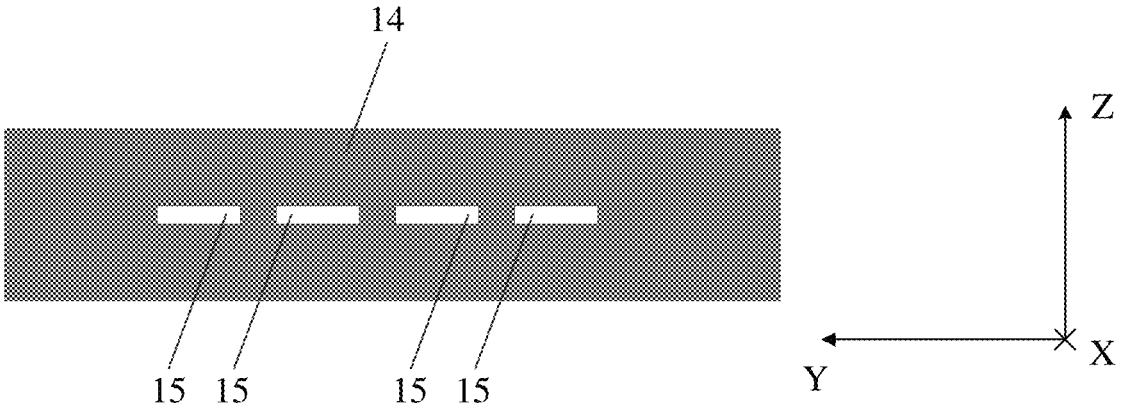
FIG. 12 is yet another schematic diagram showing a structure of a side of a metal frame, in accordance with some embodiments of the present disclosure.

As shown in FIG. 10, the two opposite sides of the terminal device are both provided with a signal reflection wall 3 formed by the metal wall of the battery chamber, and the signal reflection walls 3 on the two sides reflect a signal radiated by the second side 12 and a signal radiated by the fourth side 14, respectively. It can be seen from FIG. 11 that at least four slots 15 are provided on the second side 12. It can be seen in FIG. 12 that at least four slots 15 are provided on the fourth side 14. In this way, a main lobe of a millimeter-wave slot array formed by the slots 15 on the second side 12 points to the positive direction of the X axis, and a main lobe of a millimeter-wave slot array formed by the slots 15 on the fourth side 14 points to the negative direction of the X axis, therefore improving the beam coverage of the millimeter-wave antenna array.

Optionally, a length of the slot is determined according to a half wavelength corresponding to a center frequency of an antenna operating frequency band.

In this implementation, the length of the slot 15 may be determined based on a half wavelength corresponding to a center frequency of an antenna operating frequency band. For example, the length of the slot 15 may be approximately the half wavelength corresponding to the center frequency of the antenna operating frequency band, so that signals may be better transmitted and received.

Optionally, the antenna feedpoint is disposed at a non-central position of an inner side edge of the slot.

Figure 13:
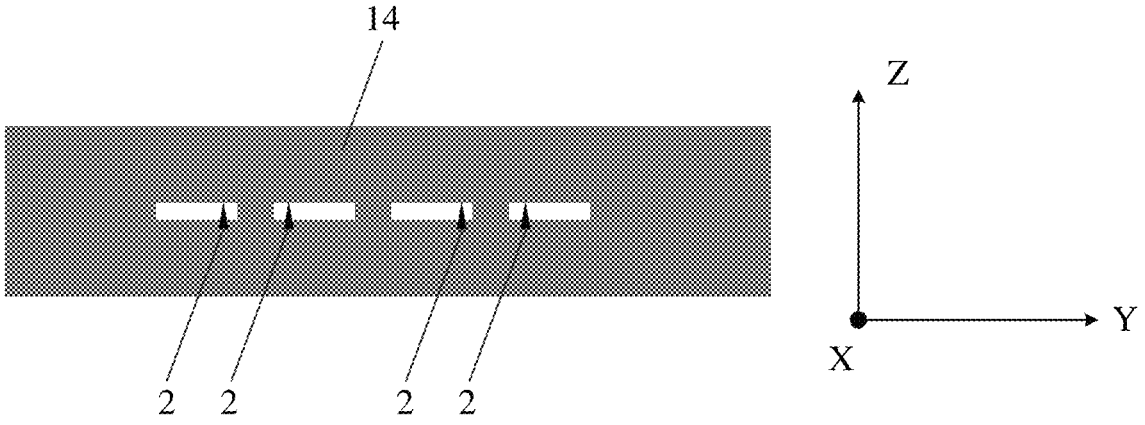
FIG. 13 is a schematic diagram of arrangement positions of antenna feedpoints, in accordance with some embodiments of the present disclosure.

In this implementation, the antenna feedpoint 2 is located at a non-central position of an edge of the slot 15, which may make the millimeter-wave antenna array have better performance. In order to better understand the above arrangement, the following description will be made with reference to FIG. 13. As shown in FIG. 13, there are at least four slots 15 on the fourth side 14, antenna feedpoints 2 of the first slot and the third slot from left to right are proximate to a right side of a center of the slot 15, and antenna feedpoints 2 of the second slot and the at least fourth slot from left to right are proximate to a left side of the center of the slot 15. The millimeter-wave antenna array may have better performance. Of course, this is merely an example of one arrangement of the antenna feedpoints 2, and there may be some other arrangements besides this, and this embodiment is not limited thereto.

Optionally, the signal reflection wall 3 may be a reflection plane.

For example, as shown in FIG. 2, there is a gap between the metal wall of the battery chamber and the metal frame 1. A width of the gap may be W0, and W0 is greater than 0. A length of the gap may be L0, and a total length of the slot group of the antenna array may be Ls, and L0 is greater than or equal to Ls. It will be understood that the gap may be filled with air or a non-conductive material. By using the metal wall of the battery chamber as the signal reflection wall 3, not only may an azimuth pattern of the antenna array be optimized, but also the implementation is simpler.

The terminal device provided by some embodiments of the present disclosure includes a metal frame provided with at least two slots on a side. At least two antenna feedpoints are provided on an inner side wall of the metal frame, and different antenna feedpoints in the at least two antenna feedpoints are disposed on side edges of different slots. A signal reflection wall is further disposed inside the terminal device, and there is a gap between the signal reflection wall and the at least two slots. The signal reflection wall is formed by a metal wall of a battery chamber of the terminal device, wherein the battery chamber is a structure that accommodates a battery of the terminal device. The metal frame and the signal reflection wall are both electrically connected to a ground plate of the terminal device. In this way, the metal frame provided with the slots is equivalent to the millimeter-wave antenna array of the terminal device, and the metal frame is also a radiating body of a communication antenna, and thus the space accommodating the millimeter-wave antenna is saved, which may reduce the volume of the terminal device and support the design of metal appearance better. Furthermore, the metal frame may be designed to be compatible with a scheme that the appearance metal serves as other antennas, so as to improve the overall competitiveness of the terminal device.

It will be noted that, the terms such as "include" and "comprise" or any other variation thereof herein are intended to cover non-exclusive inclusion, so that a process, a method, an article or an apparatus that includes a series of elements that not only includes those elements, but also includes other elements not explicitly listed or elements inherent to the process, the method, the article or the apparatus. In a case where there is no more limitation, an element defined by the phrase "including a . . . " does not exclude existence of other identical elements in a process, a method, an article or an apparatus that includes the element.

The embodiments of the present disclosure are described above with reference to the accompanying drawings. However, the present disclosure is not limited to the above specific embodiments. The above specific embodiments are merely examples and are not restrictive. Under enlightenment of the present disclosure, a person of ordinary skill in the art may make a plurality of forms without departing from spirit of the present disclosure and the protection scope of the claims, all of which shall be included in the protection scope of the present disclosure.

What is claimed is:

1. A terminal device, comprising:

a metal frame having at least two slots disposed in a side of the metal frame, at least two antenna feedpoints being disposed on an inner side wall of the metal frame, and different antenna feedpoints in the at least two antenna feedpoints being disposed on side edges of different slots; and a signal reflection wall being further disposed inside the terminal device, a gap existing between the signal reflection wall and the at least two slots, and the signal reflection wall being formed by a metal wall of a battery chamber of the terminal device; wherein the battery chamber is a structure accommodating a battery of the terminal device; the metal frame and the signal reflection wall being both electrically connected to a ground plate of the terminal device; and the signal reflecting wall is disposed opposite to the at least two slots.

2. The terminal device according to claim 1, wherein the signal reflection wall is a concave reflection curved surface.

3. The terminal device according to claim 2, wherein the reflection curved surface is formed by a generatrix parallel to a length direction of the metal frame; or the reflection curved surface is formed by a generatrix parallel to a width direction of the metal frame.

4. The terminal device according to claim 2, wherein the reflection curved surface is a paraboloid.

5. The terminal device according to claim 1, wherein an upper edge of the signal reflection wall is not lower than upper edges of the at least two slots, and a lower edge of the signal reflection wall is not higher than lower edges of the at least two slots.

6. The terminal device according to claim 1, wherein the signal reflection wall comprises at least two reflection curved surfaces each of which corresponds to an arrangement position of a respective one of the at least two slots.

7. The terminal device according to claim 6, wherein a reflection curved surface is a paraboloid, and a focus of the paraboloid coincides with a midpoint of a slot corresponding to an arrangement position of the paraboloid.

8. The terminal device according to claim 6, wherein the at least two slots are arranged in a length direction of the metal frame, each slot has a same length, and there is a same distance between any two adjacent slots.

9. The terminal device according to claim 8, wherein the distance between two adjacent slots is determined by an isolation between two adjacent antennas and a beam scanning coverage angle of an antenna array.

10. The terminal device according to claim 1, wherein a slot comprises a first sub-slot and a second sub-slot that are intersected with each other.

11. The terminal device according to claim 10, wherein the signal reflection wall comprises a first reflection curved surface that is concave and corresponding to the first sub-slot, and a second reflection curved surface that is concave and corresponding to the second sub-slot; and a generatrix forming the first reflection curved surface is intersected with a generatrix forming the second reflection curved surface.

12. The terminal device according to claim 11, wherein a long side of the first sub-slot is orthogonal to a long side of the second sub-slot; or a generatrix forming the first reflection curved surface is orthogonal to a generatrix forming the second reflection curved surface; or the long side of the first sub-slot is orthogonal to the long side of the second sub-slot, and the generatrix forming the first reflection curved surface is orthogonal to the generatrix forming the second reflection curved surface.

13. The terminal device according to claim 1, wherein two opposite sides of the metal frame are both provided with at least two slots.

14. The terminal device according to claim 1, wherein a length of a slot is determined according to a half wavelength corresponding to a center frequency of an operating frequency band of an antenna.

15. The terminal device according to claim 1, wherein an antenna feedpoint is disposed at a non-central position of an inner side edge of a slot.

16. The terminal device according to claim 1, wherein the metal frame is a radiating body of a communication antenna.

17. A terminal device, comprising a radiating body of a communication antenna, a millimeter-wave antenna array being disposed on the radiating body; wherein the radiating body is a metal frame of the terminal device, at least two slots are disposed in a side of the metal frame to form the millimeter-wave antenna array; at least two antenna feedpoints are disposed on an inner side wall of the metal frame, and different antenna feedpoints in the at least two antenna feedpoints are disposed on side edges of different slots;

the terminal device further comprises a signal reflection wall disposed inside the terminal device, a gap exists between the signal reflection wall and the at least two slots, and the signal reflection wall is formed by a metal wall of a battery chamber of the terminal device;

the battery chamber is a structure accommodating a battery of the terminal device, the metal frame and the signal reflection wall are both electrically connected to a ground plate of the terminal device, and the signal reflecting wall is disposed opposite to the at least two slots.

* * * * *